US005387085A

United States Patent [19]

Thomas, Jr, et al.

[11] Patent Number: 5,387,085

[45] Date of Patent: Feb. 7, 1995

[54] TURBINE BLADE COMPOSITE COOLING CIRCUIT

[75] Inventors: Theodore T. Thomas, Jr,, Maineville; Ching-Pang Lee, Cincinnati, both of Ohio

[73] Assignee: General Electric Company, Cincinnati, Ohio

[21] Appl. No.: 183,620

[22] Filed: Jan. 7, 1994

[51] Int. Cl.[6] ..... F01D 5/08

[52] U.S. Cl. ..... 416/97 R; 415/115

[58] Field of Search ..... 415/115, 116; 416/92, 416/96 R, 96 A, 97 R, 97 A

[56] References Cited

U.S. PATENT DOCUMENTS

| | | |
|---|---|---|
| 3,656,863 | 4/1972 | DeFeo . |
| 4,073,599 | 2/1978 | Allen et al. . |
| 4,616,976 | 10/1986 | Lings et al. . |
| 4,770,608 | 9/1988 | Anderson et al. . |
| 4,992,026 | 2/1991 | Ohtomo et al. . |
| 5,215,431 | 6/1993 | Derrien . |
| 5,246,340 | 9/1993 | Winstanley et al. . |

FOREIGN PATENT DOCUMENTS

| | | | |
|---|---|---|---|
| 0066401 | 3/1989 | Japan | 416/96 R |
| 0122705 | 7/1989 | Japan | 416/97 R |

OTHER PUBLICATIONS

U.S. patent application Ser. No. 07/935,061, filed Aug. 25, 1992, D. Kercher.

*Primary Examiner*—John T. Kwon
*Assistant Examiner*—Christopher Verdier
*Attorney, Agent, or Firm*—Jerome C. Squillaro; Bernard E. Shay

[57] ABSTRACT

A gas turbine engine airfoil includes a serpentine cooling circuit with a branch cooling circuit disposed in parallel therewith for independently controlling discharge of cooling air therefrom through respective discharge holes in pressure and suction sides of the airfoil. Metering orifices are provided between the serpentine circuit and the branch circuit for controlling flow of cooling air into the branch circuit from the serpentine circuit, and therefore controlling discharge of the cooling air from the branch discharge holes relative to the serpentine discharge holes.

10 Claims, 2 Drawing Sheets

TURBINE BLADE COMPOSITE COOLING CIRCUIT

BACKGROUND OF THE INVENTION

The present invention relates generally to gas turbine engines, and, more specifically, to cooled turbine blades and vanes therein.

In a typical gas turbine engine, one or more stages of stationary turbine vanes and rotating turbine blades are disposed downstream of an annular combustor which discharges hot combustion gases from which energy is extracted by the rotor blades and suitably used for producing work. Since the high pressure turbine (HPT) rotor blades are disposed closest to the combustor, they are subject to the hottest combustion gas temperature and therefore typically include cooling circuits therein for maintaining the maximum temperature thereof within acceptable limits for obtaining a suitable useful life of the blades. The cooling circuits are passages or channels formed inside the airfoil portion of the blade by conventional casting techniques which carry air bled from the compressor of the engine for cooling the blade. As the air passes inside the blade it removes heat from the blade, with the cooling circuits typically being configured for maximizing the amount of heat removal for minimizing overall efficiency losses in the engine. Since any air bled from the compressor is not therefore being used in the combustion process for generating energy, the bleed air provides a performance penalty.

Accordingly, typical blade cooling circuits include conventional serpentine channels both for stator vanes and rotor blades which repeatedly channel cooling air outwardly and inwardly along the radial or longitudinal axis of the blades and vanes for removing a maximum amount of heat therefrom.

Turbine blades and vanes have airfoil portions which are generally crescent in configuration with opposite generally convex suction and generally concave pressure sides joined together along leading and trailing edges of the airfoil. Accordingly, the pressure and velocity profiles of the combustion gases which flow over the airfoil pressure and suction sides varies from the leading edge to the trailing edge of the airfoil. This, in turn, affects the temperature distribution over the entire surface of the airfoil from the leading edge to the trailing edge, with the temperature distribution also varying radially from the root to the tip of the airfoil as is conventionally known.

Accordingly, the cooling circuits inside the airfoil are typically designed for each application and the associated temperature and heat loads experienced by the airfoil over its outer surface. In addition to the different temperature environment experienced by the pressure and suction sides of the airfoil, the typical airfoil also has different temperature environments, and therefore cooling needs, at its leading edge region, mid-chord region, and trailing edge region. The cooling circuits within the airfoil are therefore typically tailored for each of these three regions as well as for the pressure and suction sides of the airfoil.

Various types of conventional cooling arrangements are well known in the art and include convection cooling, impingement cooling, and film cooling which are selectively used in blade and vane cooling designs for obtaining enhanced cooling thereof. The cooling air channeled inside the airfoil removes heat by convection as well as by impingement cooling therein in some designs. The spent cooling air is then discharged from the airfoil typically through the tip thereof as well as through the pressure and/or suction side as required. In the latter case, discharge holes are conventionally formed through the airfoil sides for discharging the cooling air in a film along the surface of the airfoil to provide an insulating film cooling barrier with the combustion gases flowable thereover. Film cooling holes are typically radially spaced apart from each other in columns extending between the airfoil root and tip and at selected axial locations between the airfoil leading and trailing edges. Film cooling has a limited axial duration, and therefore, axially spaced apart columns of film cooling holes are typically utilized as required to reestablish film cooling in the axial downstream direction along the airfoil.

Fundamental to effective film cooling is the conventionally known blowing ratio which is merely the product of the density and velocity of the discharge flow from the film cooling holes relative to the product of the density and velocity of the combustion gases at the outlets of the film cooling holes. Excessive blowing ratios cause the discharged cooling air to separate or blow-off from the airfoil outer surface which degrades film cooling effectiveness. Accordingly, the airfoil must be designed to ensure effective blowing ratios while minimizing blow-off tendency and preventing backflow of combustion gases through the film cooling holes into the blade. Since the pressure and velocity of the combustion gases flowing over the pressure and suction sides of the airfoil varies, multiple cooling circuits are typically provided through the airfoil to ensure that blowing ratios for each circuit are within acceptable minimum and maximum values to prevent backflow and blow-off, respectively.

Since significant differences in static pressures and velocities of the combustion gas flow between the pressure and suction sides of an airfoil exist, the blowing ratio of the film cooling air on the pressure side is usually much higher than that on the suction side when the film cooling holes are fed by a common cooling circuit within the airfoil which must be suitably accommodated for preventing film blow-off in the airfoil outer surface.

SUMMARY OF THE INVENTION

A gas turbine engine airfoil includes a serpentine cooling circuit with a branch cooling circuit disposed in parallel therewith for independently controlling discharge of cooling air therefrom through respective discharge holes in pressure and suction sides of the airfoil. Metering orifices are provided between the serpentine circuit and the branch circuit for controlling flow of cooling air into the branch circuit from the serpentine circuit, and therefore controlling discharge of the cooling air from the branch discharge holes relative to the serpentine discharge holes.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DESCRIPTION OF THE PREFERRED EMBODIMENT(S)

Figure 1:
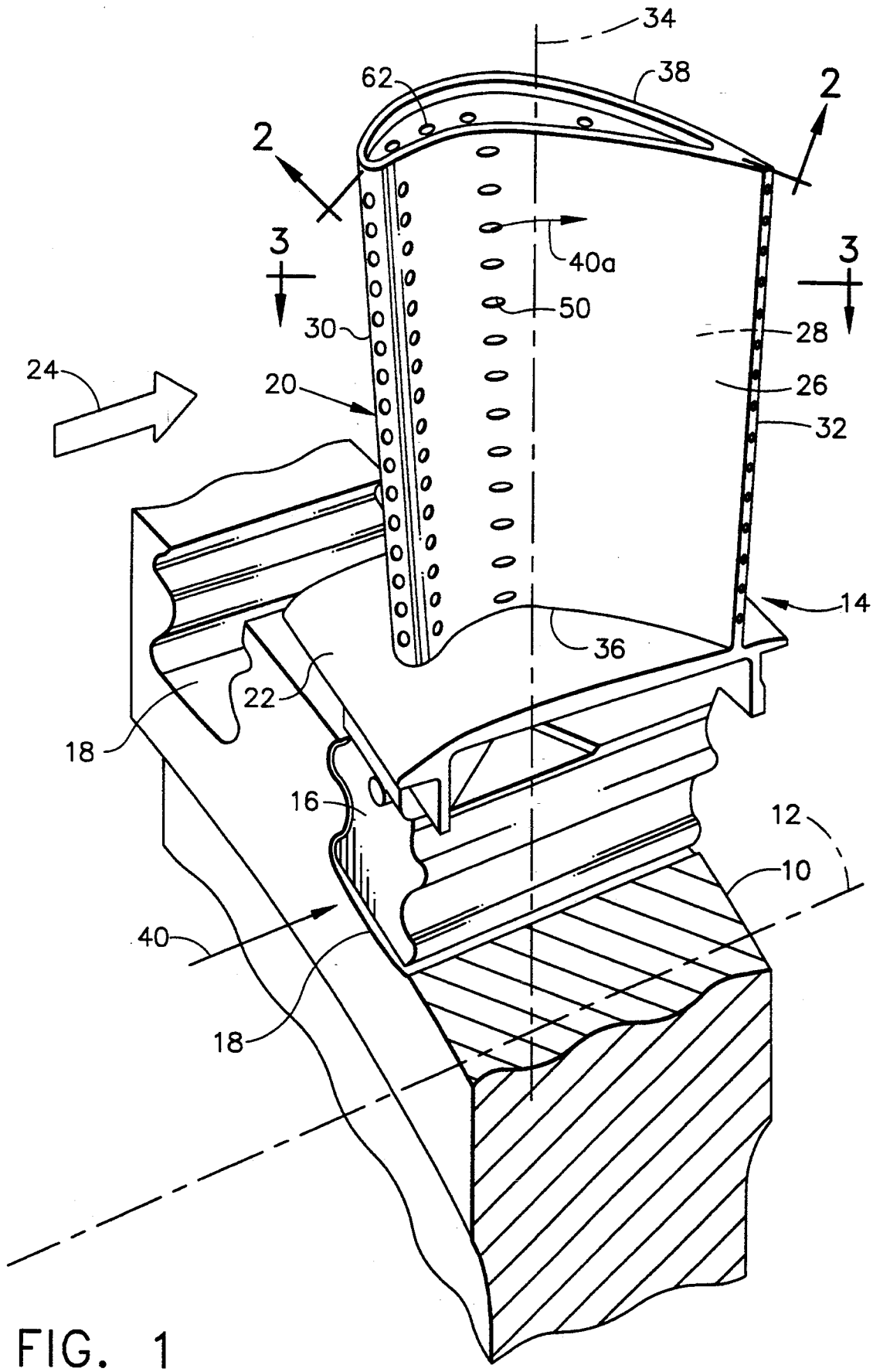
FIG. 1 is a perspective view of an exemplary gas turbine engine rotor blade joined to a portion of a rotor disk and including a composite cooling circuit in accordance with one embodiment of the present invention.

Illustrated in FIG. 1 is a portion of an annular rotor disk 10 having an axial centerline axis 12 of a typical gas turbine engine turbine section. The rotor disk 10 conventionally includes a plurality of circumferentially spaced apart rotor blades 14, one of which is illustrated, conventionally mounted thereto. More specifically, the blade 14 includes a conventional, integral axial-entry dovetail 16 which is received in a complementary dovetail slot 18 in the rotor disk 10 for mounting the blade 14 thereto in a conventional fashion. An exemplary airfoil 20 is integrally formed with the dovetail 16 and is joined thereto at a conventional platform 22 which provides an inner flowpath for combustion gases 24 which are conventionally channeled over the airfoil 20.

The airfoil 20 conventionally includes opposite pressure and suction sides 26, 28, with the former being generally concave and the latter being generally convex. The sides 26, 28 are joined together at an axially forward end along a leading edge 30, and at an opposite, axially downstream end along a trailing edge 32. The sides 26, 28, also extend radially or longitudinally along a radial axis 34 from a conventional root 36 at the platform 22 to an outer tip 38.

Cooling air 40 is conventionally bled from a compressor (not shown) of the engine and conventionally channeled upwardly through the blade dovetail 16 and into the airfoil 20 for the cooling thereof. The airfoil 20 includes an improved internal cooling arrangement as illustrated in more particularity in FIGS. 2 and 3.

More specifically, and in accordance with a preferred embodiment of the present invention, the airfoil 20 includes at least one serpentine cooling circuit or multipass channel 42 disposed therein which is formed by conventional casting methods which leave walls defining the serpentine circuit 42 as is conventionally known. The serpentine circuit 42 includes a first radial flow leg 42*a* which extends generally radially outwardly from the root 36 toward the tip 38, and in this embodiment extends also through the dovetail 16 for receiving the cooling air 40 and channeling the cooling air 40 radially outwardly therethrough. A conventional first reverse flow bend 44 is disposed adjacent the tip 38 in serial flow communication with the top of the first leg 42*a* for redirecting the cooling air 40 therefrom radially inwardly from the tip 38 toward the root 36. The first reverse bend 44 turns the flow 180° from a generally outward direction in the first leg 42*a* to a generally inward direction into a second radial flow leg 42*b* of the serpentine circuit 42 which extends radially inwardly and is disposed in serial flow communication with the first reverse bend 44 for channeling the cooling air 40 therefrom inwardly from the tip 38 toward the root 36.

In accordance with the present invention, a branch cooling circuit or channel 46 is disposed in the airfoil 20 adjacent to the serpentine circuit 42 and extends radially from the root 36 toward the tip 38. The branch circuit 46 is discrete from the serpentine circuit 42 but is disposed in parallel flow communication therewith for receiving a portion of the cooling air designated 40*a* therefrom. More specifically, a plurality of radially spaced apart first or branch metering orifices 48 are disposed in flow communication with one of the first and second legs 42*a,b* for receiving therefrom and channeling to the branch circuit 46 in parallel flow the cooling air portion 40*a* of the cooling air 40 channeled through the serpentine circuit 42. Flow through the legs of the serpentine circuit 42 is serial flow, whereas the flow through the branch circuit 46 is parallel flow since it is diverted from along the first or second leg 42*a*, 42*b*, and in this embodiment from the second leg 42*b* through the plurality of metering orifices 48. In this way, the serpentine circuit 42 provides a relatively long flowpath for maximizing removal of heat from the airfoil 20 into the cooling air 40 channeled therethrough, with the cooling air portion 40*a* then being used in turn for providing additional cooling in the branch circuit 46.

The cooling air portion 40*a* is discharged from the branch circuit 46 through a plurality of radially spaced apart branch discharge holes 50 (see FIGS. 1 and 3) which are disposed in flow communication with the branch circuit 46 and extend through one of the pressure and suction sides 26, 28 of the airfoil 20, such as the pressure side 26, for discharging the cooling air portion 40*a* from the branch circuit 46 in a film cooling layer for providing film cooling of the airfoil pressure side 26.

Figure 2:
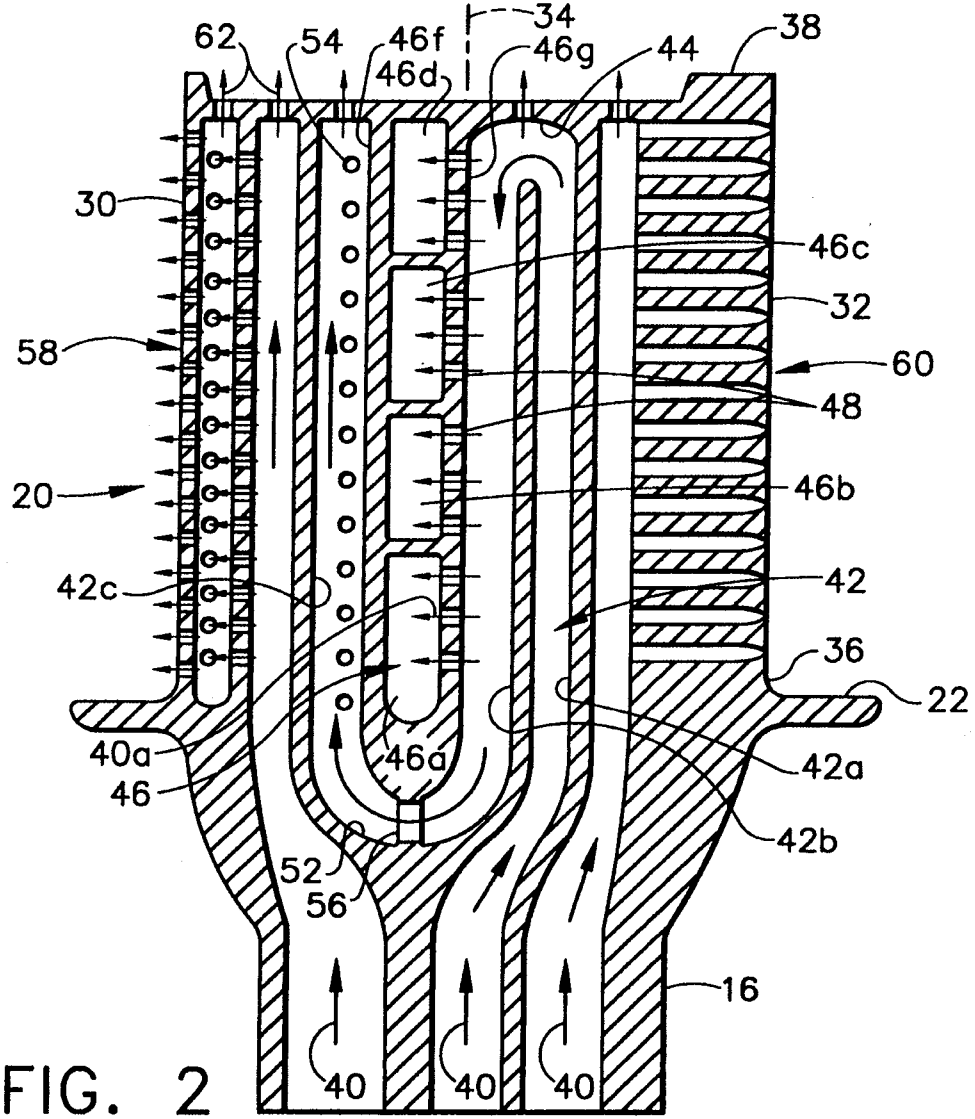
FIG. 2 is a radial or elevation sectional view through the rotor blade illustrated in FIG. 1 and taken along line 2—2.

In the exemplary embodiment illustrated in FIG. 2, the serpentine circuit 42 is a three-pass circuit and further includes a third radial flow leg 42*c* extending radially outwardly from the root 36 toward the tip 38. The third leg 42*c* is disposed in serial flow communication with a second reverse flow bend 52 disposed adjacent to the airfoil root 36, below the platform 22 in this exemplary embodiment, and in serial flow communication with the second leg 42*b* for redirecting the cooling air therefrom outwardly from the root 36 toward the tip 38. Also in this exemplary embodiment, a plurality of radially spaced apart discharge holes 54 for the serpentine circuit 42, i.e. serpentine discharge holes 54, are disposed in flow communication with the serpentine circuit 42, such as the third leg 42*c* thereof for example.

Whereas the branch discharge holes 50 extend through one side, e.g. the pressure side 26, the serpentine-circuit discharge holes 54 extend through the other of the pressure and suction sides 26, 28, i.e. the suction side 28 in this embodiment, for discharging the cooling air from the serpentine circuit 42 for providing a film cooling layer for film cooling the suction side 28. Since the branch circuit 46 receives its cooling air from the serpentine circuit 42, for example from the second leg 42*b* thereof, the branch metering holes 48 are effective for independently controlling discharge of the cooling air portion 40*a* from the branch discharge holes 50 on the airfoil pressure side 26 relative to discharge of the cooling air 40 from the serpentine discharge holes 54 on the airfoil suction side 28. This is a significant feature of the present invention since both sets of film cooling holes, i.e. the discharge holes 50 of the branch circuit 46 and the discharge holes 54 for the serpentine circuit 42, are fed from a common air source in the serpentine circuit 42. In this way, the heat pickup advantage of the serpentine circuit 42 is retained, while also providing independent control of the flows through the discharge film cooling holes 50, 54 on the opposite sides of the airfoil 20. Since significant differences in static pressure and velocity of the combustion gases 24 exist over the pressure and suction sides 26, 28 as is conventionally known, the blowing ratio of the film cooling air over the branch discharge holes 50 may be reduced by the pressure drops obtained across the branch metering orifices 48 thusly reducing film blow-off tendency from the branch discharge holes 50.

Figure 3:
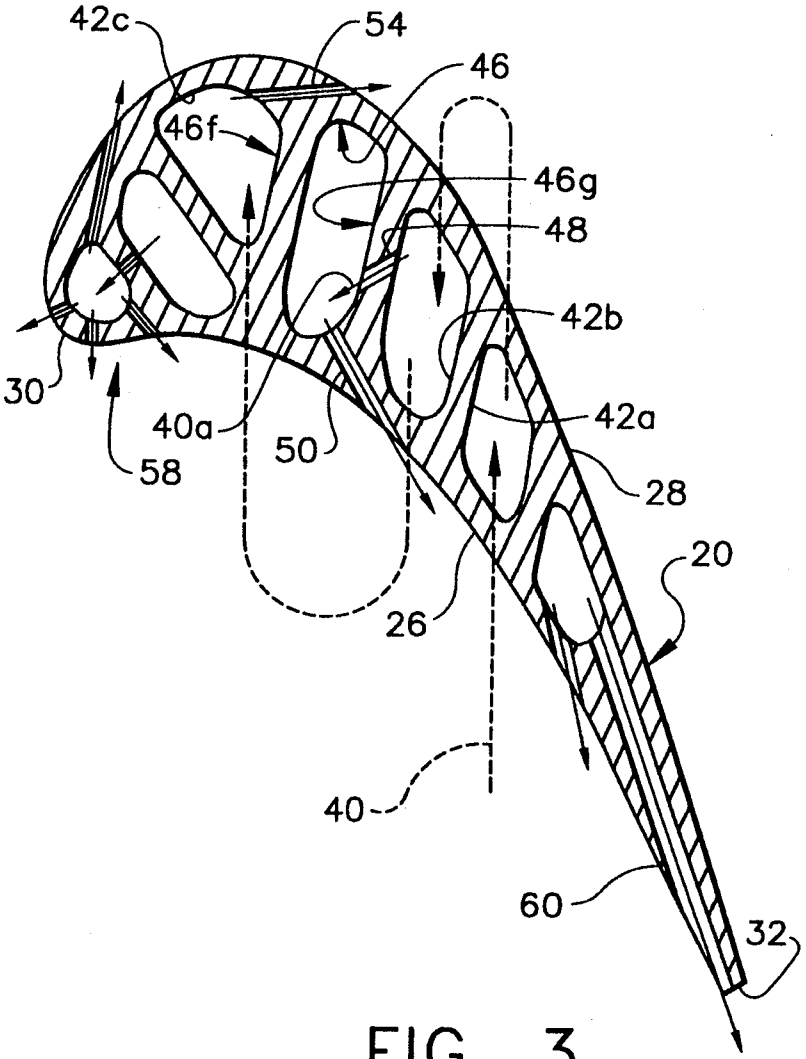
FIG. 3 is a transverse sectional view through the airfoil of the blade illustrated in FIG. 1 and taken along line 3—3.

In the preferred embodiment illustrated in FIGS. 2 and 3, both the serpentine and branch circuits 42, 46 are conventionally cast with radially extending internal walls or partitions defining the axial boundaries thereof, and with the pressure and suction sides defining the circumferential sides thereof. For example, the branch circuit 46 is disposed between the second and third legs 42*b,c* and shares its forward partition 46*f* with the third leg 42*c*, end shares its aft partition 46*g* with the second leg 42*b*.

The forward and aft partitions 46*f,g* extend the full circumferential width of the airfoil 20 between the pressure and suction sides 26, 28 so that the branch circuit 46 extends uninterrupted therebetween and defines a single flow channel without additional internal ribs. The metering holes 48 may therefore be directed through the aft partition 46*g* directly toward the pressure side 26 as shown in FIG. 3, or directly toward the suction side 28 in another embodiment not shown. In this way either the pressure or suction side 26, 28 is directly impingement cooled by the metering holes 48 without cooling of additional internal ribs which could create undesirable differential strains reducing blade life.

As illustrated in FIG. 3, the branch metering orifices 48 are preferably inclined in the airfoil 20 in the circumferential direction with their outlets being disposed closer to one of the pressure and suction sides 26, 28 than their inlets are. For example, in the exemplary embodiment illustrated in FIG. 3, the branch metering orifices 48 extend through the aft partition 46*g* and have their outlets disposed closer to the inside surface of the pressure side 26, with their inlets being disposed further away so that they are inclined for channeling the cooling air portion 40*a* from the second leg 42*b* of the serpentine circuit 42 in impingement against the inside surface of the pressure side 26 prior to discharge from the branch discharge holes 50. In the exemplary embodiment illustrated in FIG. 3, greater cooling is desired on the pressure side 26 adjacent to the branch circuit 46 and therefore the metering orifices 48 are so inclined. However, in an alternate embodiment of the invention, the branch metering orifices 48 could be oppositely inclined toward the suction side 28 if additional impingement cooling thereof is desired. Yet in other embodiments, the branch metering orifices 48 may be alternately inclined toward the inside surfaces of both the pressure and suction sides 26, 28.

In the exemplary embodiment of the invention applied to a rotor blade as illustrated in FIG. 2, the branch circuit 46 includes a plurality of discrete radially adjoining branch chambers or manifolds such as the four manifolds 46*a–d* illustrated in FIG. 2. Since the airfoil 20 rotates during operation, the pressure and velocity distributions of the combustion gases flowable thereover vary in the radial direction. By configuring the branch cooling circuit 46 into a plurality of two or more independent manifolds 46*a–d* separated by partitions, each manifold 46*a–d* can independently receive cooling air through a respective fraction or portion of the branch metering orifices joined thereto, and independently discharge the cooling air therefrom through a respective fraction or portion of the branch discharge holes 50 joined thereto. In this way, crossflow of the cooling air portion 40*a* radially upwardly between the independent manifolds 46*a–d* is prevented, which therefore prevents degradation of impingement cooling due to such crossflow. And, the flow areas of the respective branch metering orifices 48 of each of the manifolds 46*a–d* can be predeterminedly tailored for each of the manifolds 46*a–d* to provide enhanced cooling in each manifold 46*a–d* and enhanced film cooling from the respective branch discharge holes 50.

In the exemplary embodiment illustrated in FIG. 2, both the serpentine and branch circuits 42, 46 are disposed in the mid-chord region of the airfoil 20, with the branch circuit 46 being disposed axially between the second and third legs 42*b,c* of the serpentine circuit 42, with the branch circuit 46 being fed cooling air from the second leg 42*b*. In this configuration, the second reverse bend 52 may also include a metering orifice 56 for the serpentine circuit 42 for predeterminedly dropping pressure of the cooling air 40 channeled therethrough to the third leg 42*c* for additionally controlling discharge of the cooling air from the serpentine discharge holes 54 in the third leg 42*c*. Since both sets of film cooling discharge holes 50, 54 for the branch and serpentine circuits 46, 42 are fed from the common cooling air 40 channeled through the first leg 42*a*, the respective metering orifices 48, 56 may be predeterminedly sized for independently controlling pressure, and therefore the blowing ratios of the film cooling air through the respective discharge holes 50, 54 on opposite sides of the airfoil 20.

As illustrated in FIGS. 2 and 3, the airfoil 20 includes additional, conventional cooling circuits disposed between the mid-chord region and the leading and trailing edges 30, 32. A conventional leading edge cooling circuit 58 includes an inlet channel extending from the dovetail 16 to the tip 38 which feeds a parallel, radially extending manifold at the leading edge 30 through a plurality of radially spaced apart metering orifices. In the exemplary embodiment illustrated in FIG. 3, the leading edge cooling circuit 58 includes four columns of film cooling holes for providing film cooling air from the leading edge 30 rearwardly along portions of both the pressure and suction sides 26, 28.

A conventional trailing edge cooling circuit 60 includes an inlet channel extending from the dovetail 16 to the tip 38 adjacent the trailing edge 32 which feeds a plurality of axially extending trailing edge discharge holes. The airfoil 20 includes conventional tip outlets 62 disposed in flow communication with the leading and trailing edge cooling circuits 58, 60 as well as the serpentine circuit 42 for discharging a portion of the cooling air 40 through the tip 38 for providing cooling thereof in a conventional manner.

Accordingly, the invention may be used with conventional cooling circuits in a gas turbine engine rotor blade 14 as described above for providing enhanced cooling thereof. For example, the composite of the serial flow serpentine circuit 42 in conjunction with the branch-out parallel circuit 46 allows independent control of the film air driving pressures for the pressure and suction sides 26, 28, and therefore independent control of the blowing ratios across the respective discharge holes 50, 54. The radial partitions separating the branch circuit manifolds 46*a–d* allow the cooling air pressures to be further controlled in the radial direction to match the exterior distribution. The radial partitions also prevent crossflow between the independent manifolds 46*a–d* to further improve heat transfer of the impingement cooling. And, all of the features described above may be simply formed in a conventional manner using conventional casting techniques.

Although the branch circuit 46 is disclosed above as being disposed between the second and third legs 42*b,c*, it may be disposed alternatively where desired. Furthermore, the branch circuit 46 may alternatively be disposed in flow communication with other legs of the serpentine circuit 42 as desired.

Of course, various arrangements of cooperating serpentine and branch cooling circuits as described above may be obtained from the teachings herein as desired for each design application. The invention is significant, for example, in allowing independent control of film cooling discharge holes on both sides of the airfoil 20 from a common cooling air source while maintaining suitably low blowing ratios and avoiding blow-off flow separation of the film cooling air from the apertures. The invention may also be applied to stationary stator blades or vanes where it is desired to similarly control blowing ratios on both sides of the airfoil when provided with cooling air from a common cooling circuit source.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is claimed and desired to be secured by Letters Patent of the United States is the invention as defined and differentiated in the following claims:

1. A gas turbine engine blade comprising:

an airfoil having opposite first and second sides joined together at leading and trailing edges, and extending radially from a root to a tip;

a serpentine cooling circuit disposed in said airfoil and having a first leg extending from said root toward said tip for channeling cooling air outwardly therethrough, a first reverse bend disposed adjacent to said tip in flow communication with said first leg for redirecting said cooing air therefrom inwardly from said tip toward said root, and a second leg extending inwardly and disposed in flow communication with said first reverse bend for channeling said cooling air inwardly therefrom;

a discrete branch cooling circuit disposed in said airfoil adjacent to said serpentine circuit and extending radially from said root to said tip;

a plurality of branch metering orifices disposed in flow communication with said serpentine circuit for channeling therefrom to said branch circuit in parallel flow a portion of said cooling air channeled through said serpentine circuit;

a plurality of branch discharge holes disposed in flow communication with said branch circuit and extending through said airfoil first side for discharging said cooling air portion from said branch circuit for film cooling said airfoil first side;

a plurality of discharge holes for said serpentine circuit disposed in flow communication with said serpentine circuit and extending through said airfoil second side for discharging said cooling air from said serpentine circuit for film cooling said airfoil second side; and wherein said branch metering holes are effective for independently controlling discharge of said cooling air portion from said branch discharge holes on said airfoil first side relative to discharge of said cooling air from said serpentine discharge holes on said airfoil second side.

2. A blade according to claim 1 wherein said branch metering orifices are inclined in said airfoil for channeling said cooling air portion from said serpentine circuit in impingement against an inside surface of said airfoil prior to discharge from said branch discharge holes.

3. A blade according to claim 2 wherein said branch circuit includes a plurality of radially adjoining branch manifolds for independently receiving cooling air through a respective portion of said branch metering orifices, and for independently discharging said cooling air therefrom through a respective portion of said branch discharge holes.

4. A blade according to claim 2 wherein said serpentine circuit further comprises:

a second reverse bend disposed adjacent to said root in serial flow communication with said second leg for redirecting said cooling air therefrom outwardly from said root toward said tip;

a third leg extending outwardly from said root toward said tip and disposed in flow communication with said second reverse bend for channeling said cooling air outwardly therefrom; and wherein said branch circuit is disposed between said second and third legs.

5. A blade according to claim 4 wherein said serpentine discharge holes are disposed in flow communication with said third leg.

6. A blade according to claim 5 wherein said second reverse bend includes a serpentine metering orifice for predeterminedly dropping pressure of said cooling air channeled therethrough to said third leg for controlling discharge of said air from said serpentine discharge holes in said third leg.

7. A blade according to claim 6 wherein said airfoil first and second sides are pressure and suction sides, respectively, and said serpentine discharge holes are disposed through said airfoil suction side, and said branch discharge holes are disposed through said airfoil pressure side.

8. A blade according to claim 7 wherein said branch metering holes are disposed in flow communication with said first leg and are inclined in said airfoil toward said airfoil pressure side for impingement cooling said inside surface of said pressure side.

9. A blade according to claim 8 wherein said blade further includes a dovetail integrally joined to said airfoil adjacent to said root for mounting said blade to a rotor disk, with said tip being disposed radially outwardly from said root, and wherein said serpentine circuit extends in part into said dovetail.

10. A blade according to claim 9 wherein said parallel serpentine and branch cooling circuits are disposed in a mid-chord region of said airfoil between said leading and trailing edges, and said airfoil further comprises additional independent cooling circuits disposed between said mid-chord region and said leading and trailing edges.

* * * * *